US009850620B2

(12) United States Patent
Ott

(10) Patent No.: US 9,850,620 B2
(45) Date of Patent: Dec. 26, 2017

(54) DRYER VENT

(71) Applicant: Keith H. Ott, Bonita Springs, FL (US)

(72) Inventor: Keith H. Ott, Bonita Springs, FL (US)

( * ) Notice: Subject to any disclaimer, the term of this patent is extended or adjusted under 35 U.S.C. 154(b) by 300 days.

(21) Appl. No.: 14/693,113

(22) Filed: Apr. 22, 2015

(65) Prior Publication Data

US 2015/0354127 A1 Dec. 10, 2015

Related U.S. Application Data

(60) Provisional application No. 62/008,088, filed on Jun. 5, 2014.

(51) Int. Cl.

| | |
|---|---|
| ***D06F 58/20*** | (2006.01) |
| ***F24F 7/00*** | (2006.01) |
| ***F24F 13/08*** | (2006.01) |

(52) U.S. Cl.

CPC ..... *D06F 58/20* (2013.01); *F24F 7/00* (2013.01); *F24F 13/082* (2013.01); *F24F 2007/003* (2013.01)

(58) Field of Classification Search

CPC ... D06F 8/20; F24F 13/082; F24F 7/00; F24F 2007/003

USPC ..... 34/235; 454/367, 359

See application file for complete search history.

(56) References Cited

U.S. PATENT DOCUMENTS

| | | | | |
|---|---|---|---|---|
| 3,145,643 | A * | 8/1964 | Strouth | F24C 15/20 126/299 D |
| 3,285,155 | A * | 11/1966 | Maltenfort | F24F 13/08 454/359 |
| 4,047,475 | A * | 9/1977 | Cox | A62C 2/12 454/357 |
| 5,344,363 | A * | 9/1994 | Pollock | B65D 90/34 137/527.8 |
| 6,772,538 | B2 | 8/2004 | Vagedes | |
| 7,988,544 | B2 | 8/2011 | Vanden Bosch et al. | |
| 2011/0097990 | A1 * | 4/2011 | Charron | |

* cited by examiner

*Primary Examiner* — Jessica Yuen
(74) *Attorney, Agent, or Firm* — Price Heneveld LLP

(57) ABSTRACT

A vent apparatus comprises a mount with air flow opening for mounting to a wall, a housing covering the mount, and a door pivoted to fall by gravity to a closed position but being movable to an open position when air flows from the air outflow passageway. The housing forms a downwardly and outwardly open chute extending well below a bottom of the mount and door, thus discouraging birds from approaching the air flow opening. The door and mount include bottom flanges that overlap when the door is in the closed position, further discouraging bird entry. The mount, housing and door are all metal with stiffening bends that are relatively simple construction, making assembly tow cost and providing a reliable function. The housing does not include large horizontal surfaces, thus discouraging birds and animals from building a nest in or on the housing.

5 Claims, 6 Drawing Sheets

DRYER VENT

CROSS-REFERENCE TO RELATED APPLICATION

This application claims benefit under 35 USC section 119(e) of U.S. Provisional Application Ser. No 62/008,088, filed Jun. 5, 2014, entitled DRYER VENT, the entire contents of which are incorporated herein by reference.

BACKGROUND OF THE INVENTION

The present invention relates to dryer vents and building air vents, and more particularly relates to a vent apparatus mountable to a building wall for passing air to the outside of a building, with the present vent apparatus including features preventing birds and animals from entering the vent, and discouraging them from building nests in or on the vent. A scope of the present apparatus is not believed to be limited to only dryer vents, and instead the present invention is believed to be applicable to any air outlet from a building, such as bathroom fans, kitchen fans, furnace air outlets and other air outlets.

Dryer vents on a building's exterior walls are attractive to animals, especially birds, because they are warm, often sheltered, and often in hidden or non-busy locations. However, the presence of birds, animals and/or their nests can restrict air flow and/or cause debris to accumulate in the air outlet passageway, creating fire and/or smoke hazards and otherwise adversely affect a dryer's operation. It can also lead to a foul smell and unsanitary conditions. Notably, these are the kind of problems that are rarely recognized ahead of time, but instead are usually found when more serious issues arise.

Some bird/animal restricting vent devices exist or have been proposed, but known vent devices are undesirably complicated and/or expensive and/or not as durable and robust as desired and/or do not function effectively. One such device (see Vagedes U.S. Pat. No. 6,772,538) includes a rotating paddlewheel or fan blade that purportedly blocks entry of birds and also creates movement frightening any bird or animal away. However, the rotating paddlewheel adds considerable expense to the device based on part cost. Also, as a practical matter, it doesn't take much to cause the paddlewheel to hang up or stop moving freely, resulting in lack of function, warranty (if the problem is even noticed), and potentially other in-service problems related to lack of function and/or poor air flow. Most homeowners will not realize that the paddlewheel has stopped moving, nor that his/her dryer has lost efficiency, until a serious problem arises with the dryer. Also, there are questions about whether the paddle-wheel's movement will actually frighten birds after the birds become desensitized over a period of time.

Another such device, shown in Vanden Bosch U.S. Pat. No. 7,988,544 includes complexly shaped parts with overlapping flanges (see FIGS. 3*a* and 3*b*). The parts complexity (see FIGS. 4, 5*a*, 6*a*), requires that they he injection molded of plastic, which potentially results in high tooling and manufacturing cost. Also, the up-facing lower flange of the door and also a top of the housing (see FIG. 3*a*) provides semi-horizontal surfaces that a bird or animal (or wasp) could potentially start to build a nest on, such as if the vent is not used for a period of time. Notably, the door's movement will not tend to dislodge any partially-built nest (see FIG. 3*b*). Still further, the part's complex shapes and overlapping flanges potentially lead to clearance and tolerance problems in the assembled product, such that considerable assembly time and quality control effort must be made to assure the door will move as intended both during initial manufacture and also during extended use in the field.

An improvement is desired that provides savings and improvements in terms of simpler and lower cost parts, lower capital investment, increased efficiency and ease of installation, robustness, safety, and improved long term operation.

SUMMARY OF THE INVENTION

In one aspect of the present invention, a vent apparatus for assembly to a building exterior wall, comprises: a mount adapted for attachment to a building exterior wall and having an air flow opening generally matching an air outflow passageway in the building exterior wall; a housing attached to and covering the mount, the housing including a top wall, opposing side walls, and an angled wall connecting the top and side walls; and a door pivoted to the mount for movement by gravity to a closed position but being movable to an open position when air flows out from the air outflow passageway. The side walls join with the angled wall to form a downwardly and outwardly-extending chute extending below a bottom edge of the mount and door. By this arrangement, the angled wall and side walls make bird access to the air outflow opening very difficult.

In another aspect of the present invention, a vent apparatus for assembly to a building exterior wall, comprises: a mount formed from a first metal sheet with a folded stiffening flange on at least three edges and adapted for attachment to a building exterior wall and having an air flow opening generally matching an air outflow passageway in the building exterior wall; a housing formed from a second metal sheet with a center flat panel and at least three folded edge sections, the housing being attached to and covering the mount with the center flat panel located over the mount, the center flat panel forming an angled wall with the three folded edge sections forming opposing side walls and a top wall of the housing; and a door formed from a third metal sheet with at least three edge flanges. The door is pivoted to one of the mount and the housing for movement about an axis that causes the door to fall by gravity to a. closed position, but is movable to an open position when air flows through the air flow opening outward from the air outflow passageway.

These and other aspects, objects, and features of the present invention will be understood and appreciated by those skilled in the art upon studying the following specification, claims, and appended drawings.

DETAILED DESCRIPTION OF PREFERRED EMBODIMENT

Figure 1:
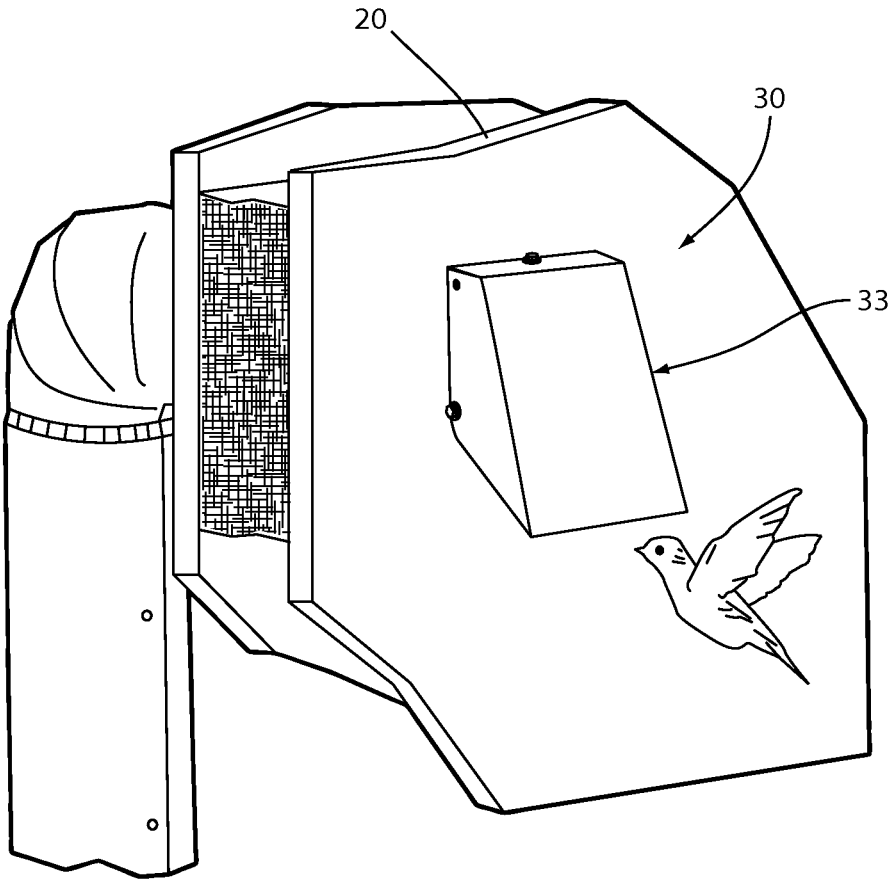
FIG. 1 is a perspective view showing a building wall with dryer vent.
Figure 2:
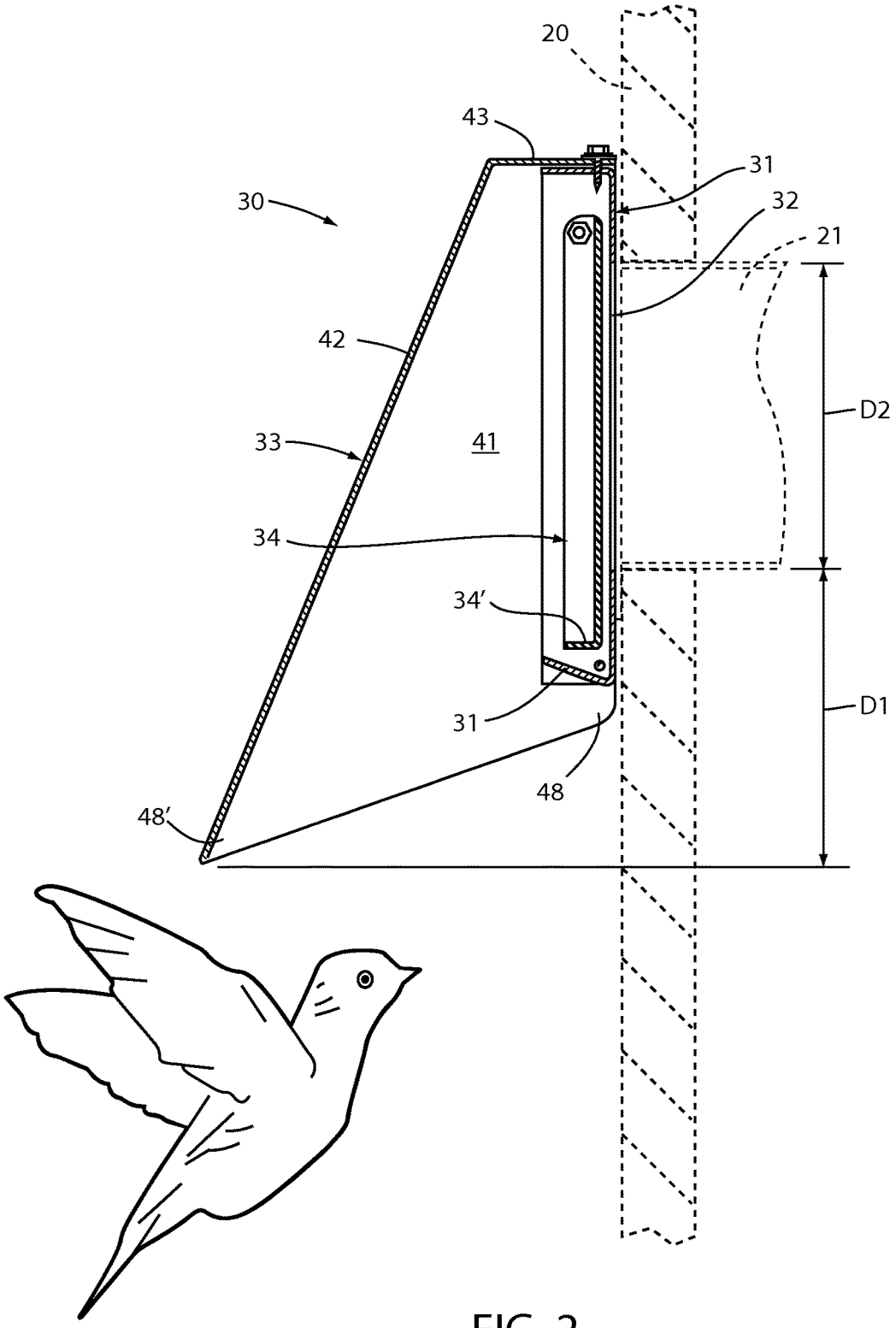
FIGS. 2-3 are side views of the vent apparatus with the closest side section of the housing removed to show underlying components, FIG. 2 showing the door closed, and FIG. 3 showing the door open.
Figure 3:
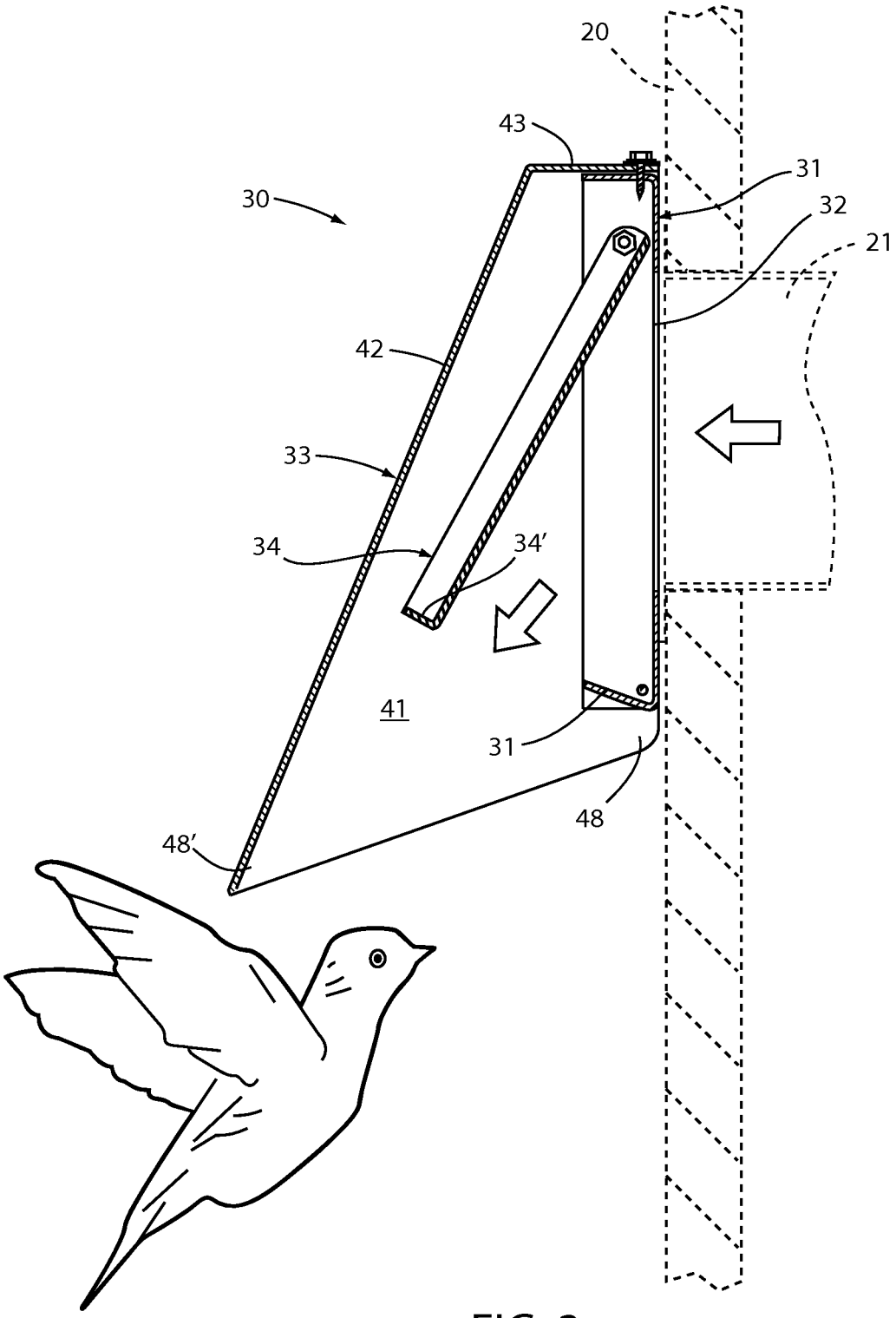
Figure 4:
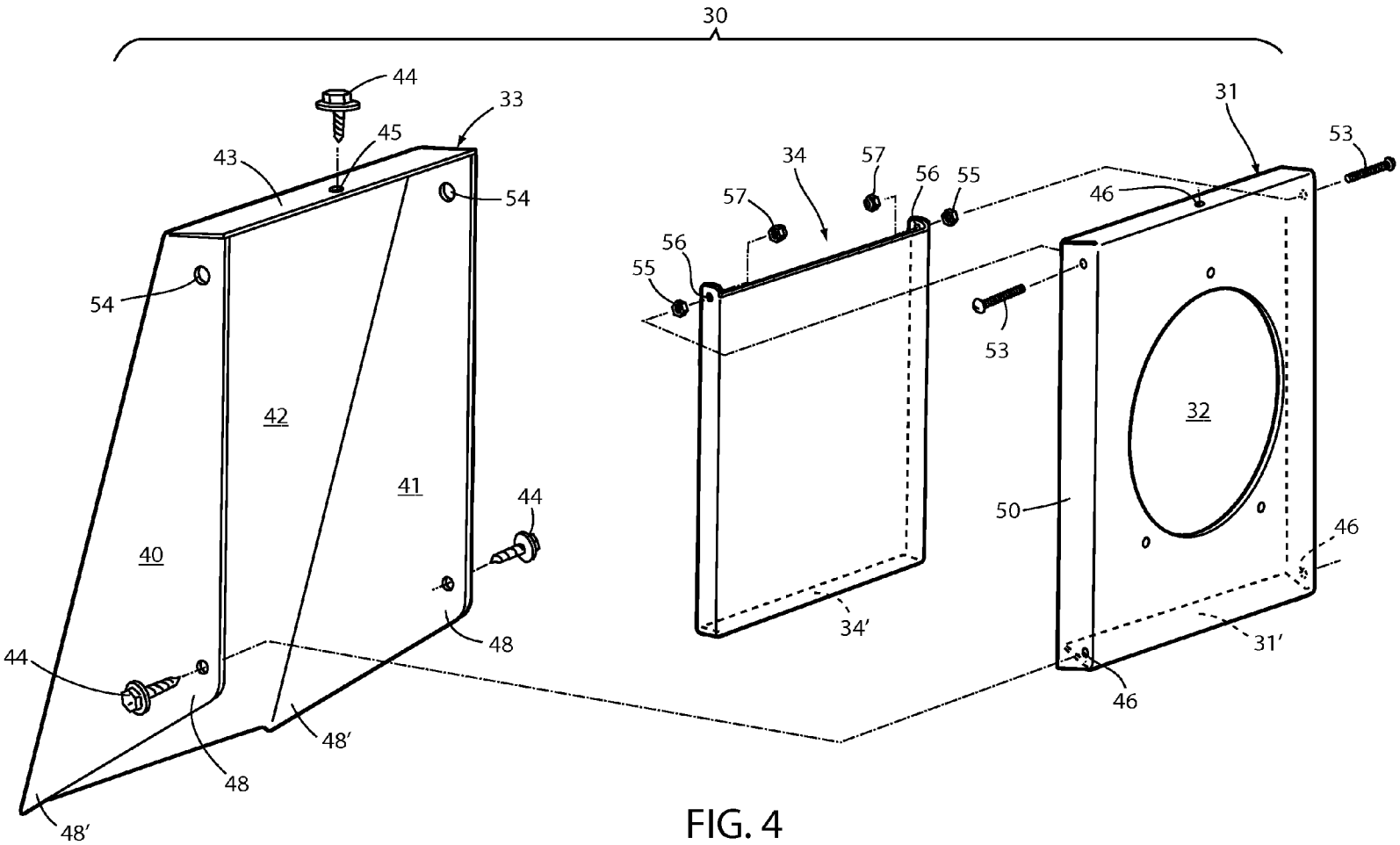
FIG. 4 is an exploded perspective view of the housing, the door, and the mount of FIG. 1.
Figure 5:
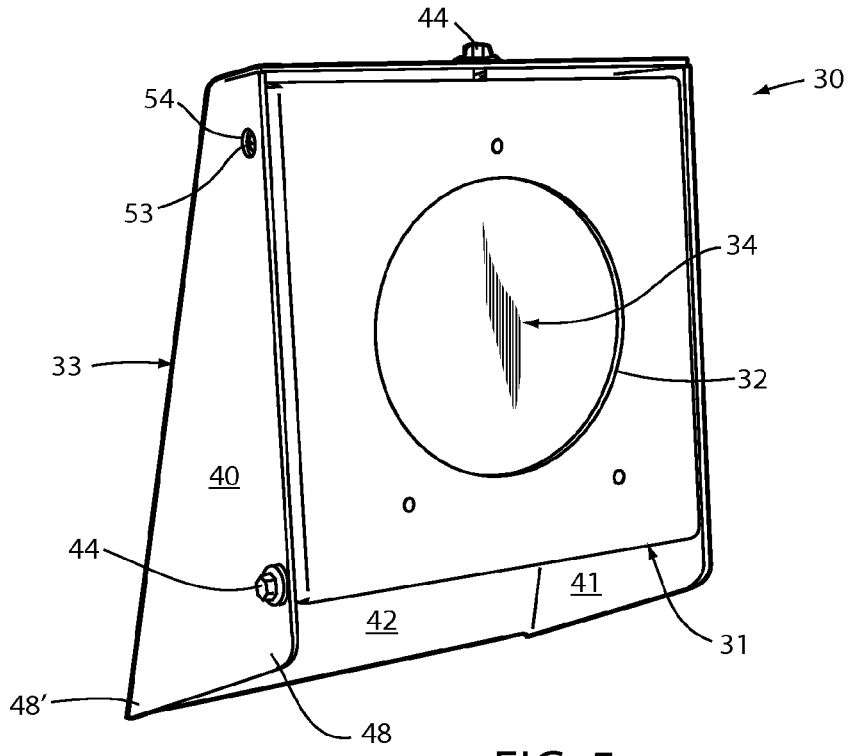
FIG. 5 is a perspective view of FIG. 1 from the mount-side of the assembly.
Figure 6:
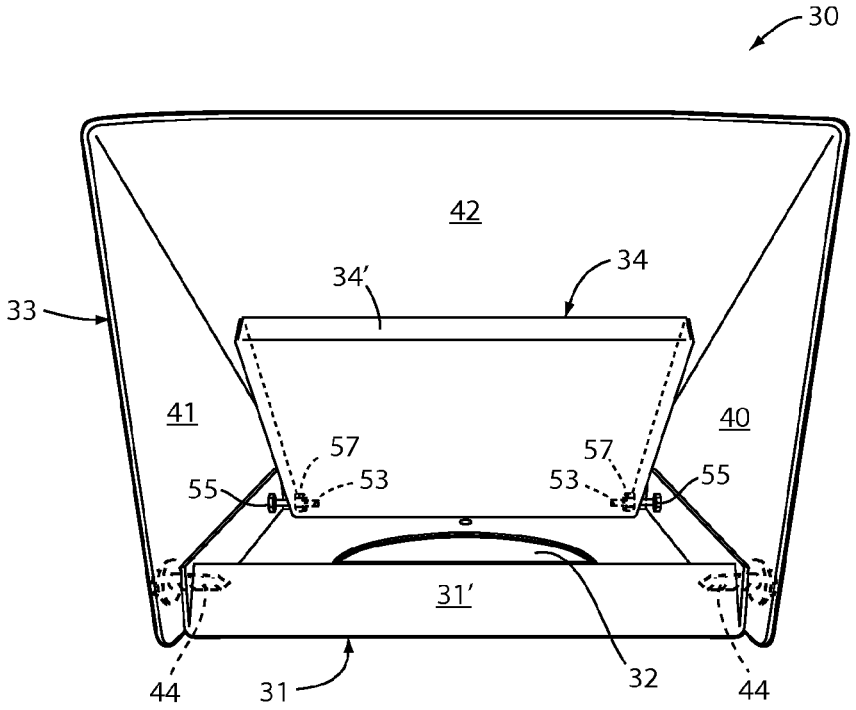
FIGS. 6-7 are bottom perspective and side views of the apparatus in FIG. 3 with the door open.
Figure 7:
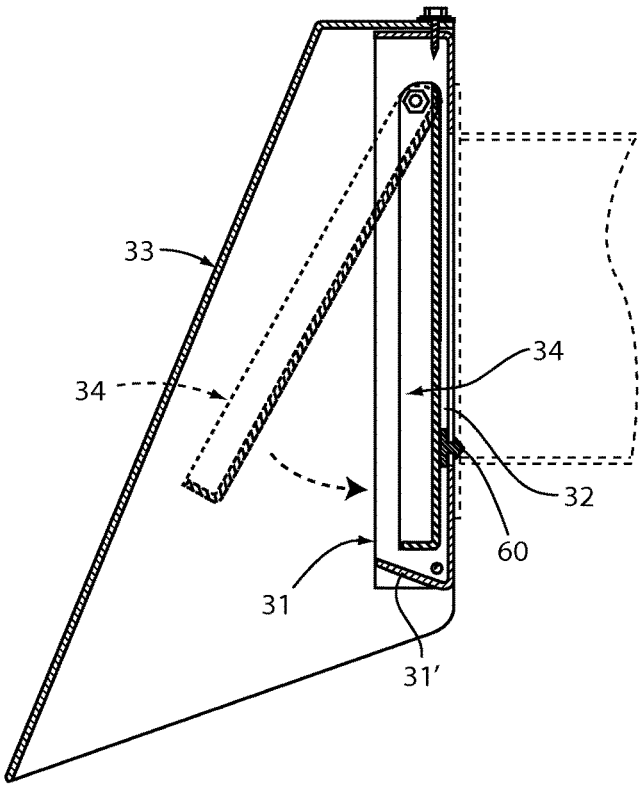

The present vent apparatus 30 (FIGS. 1-4) for a building exterior wall 20 comprises a mount 31 with air flow opening 32, a housing 33 covering the mount 31, and a door 34 pivoted for movement to fall by gravity to a closed position (FIG. 2) but being movable to an open position (FIG. 3) when air flows from the air outflow passageway 21 through air flow opening 32. A shape of the housing 33 and the overlapping construction of the mount 31 and door 34 reduce a likelihood of a bird, animal or even insects from building a nest on or in the apparatus 30, as discussed below, The housing 33 (FIG. 4) is made from one piece and includes opposing side walls 40, 41, an angled wan 42, and a top wall 43 that join to form a downwardly and outwardly-extending chute extending well below a bottom edge of the mount 31 and door 34. A size and shape of the chute discourages birds from approaching the air flow opening 32 and from building a nest inside or on the apparatus 30 due to lack of a large flat horizontal surface to do so. The door 34 and mount 31 include bottom flanges 34' and 31' extending in non-parallel planes but extending generally horizontally, such that they overlap when the door 34 is in the closed position. This overlap further discourages bird, animal, or insect entry. The mount 31, housing 33 and door 34 are all metal of relatively simple construction, each including a relatively flat main panel and having stiffening bends or bent panel sections that extend from edges of the flat main panel. This provides an unusually low part cost, low assembly cost, and a highly robust and reliable function.

As noted above, the housing 33 includes opposing side walls 40, 41 and an angled wall 42 and top wall 43 that join to form a downwardly and outwardly-extending chute extending well below a bottom edge of the mount 31 and door 34. The housing 33 can be made from a single flat sheet, with the walls 40-41, 43 being formed by single bends along edges of the main angled panel 42. Three self-threading screws 44 extend through holes 45 in the housing 33 into holes 46 in the mount 31 to fix the housing 33 to the mount 31. Notably, a bottom edge of the angled wall 42 extends below the mount 31 sufficiently to better accomplish its purpose of preventing access the opening 32. For example, a preferred dimension D1 is preferably at least about 50% of the diameter D2 of the air flow opening 32. However, it is noted that this dimension can be varied as needed to satisfy requirements of a particular installation. Also, the side walls 40-41 of the housing 33 define an inner lower corner 48 adjacent the building that preferably extends at least about a ½" below the mount 31. The outer corner 48' of the housing 33 extends significantly downward from the inner lower corner 48, which also help prevent access to the air flow opening 32. Atop flange of the housing 33 is sufficiently small to make it difficult for a bird to build a nest on the housing 33, especially when combined with the angled outer wall 42.

A size and shape of the chute defined by the housing 33 can be varied as desired for a particular installation or geographic region. The illustrated housing has a top wall dimension of about 1½"×7", and an angled wall dimension of about 7"×10½". The angled wall is angled at about 20-30 degrees from vertical, and the side wall dimensions are about 7½" vertical and about 4½" width (measured horizontally from a lower edge under the mount 31), with a maximum length of 10½" along its longest edge that is connected to the angled wall of the housing 33. The narrow top wall 43 prevents (or at least discourages) a nest from being built on top of the apparatus 30, and the angled orientation of the angled wall 42 along with the door 34 and mount 31 prevent any nest from being built inside the housing 33.

The mount 31 is about 7" vertically and 7" wide, and includes stiffening flanges 50 on all four edges of its main flat panel that defines the air flow opening 32. All of the stiffening flanges 50 are about ½" in width, and are formed perpendicularly to the main flat panel, except the bottom stiffening flange 50. The bottom stiffening flange 50 is angled upwardly toward the door 34, such as about 20 degrees from horizontal, and is slightly longer in length than the bottom flange of the door 34. This creates an overlap that is difficult for birds or animals to open. It is noted that some birds and animals can learn how to open doors if there is sufficient structure for them to do so. Notably, dust, debris and lint can accumulate in vents, resulting in a door being held partially open, leading to a problem over time.

The illustrated door 34 includes a main flat panel and includes stiffening flanges 52 on its sides along with bottom flange 34'. The illustrated door 34 does not include any stiffening flange on its top edge. A threaded bolt 53 extends through a hole 54 in each side of the housing 33 and includes a first nut 55 that fixedly captures the mount 31 on the housing 33. The bolt 53 extends through a $2^{nd}$ hole 56 at a top of the door's side edge flanges, and a second nut 57 spaced from not 55 loosely captures the door 34 on the bolt 53, allowing the door 34 to pivot freely on the bolt 53. When assembled, the axes A1-A3 are all collinear.

Figure 8:
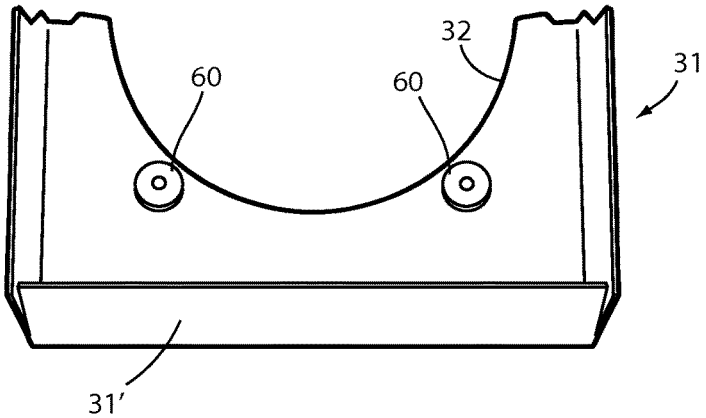
FIG. 8 is a fragmentary view of an inside lower half of the mount, including rubber grommets eliminating noise from the door closing.

Rubber grommets 60 (FIG. 8) can be added in the mount 31 to dampen door closure, thus reducing noise from the door falling closed. The illustrated grommets 60 are in a low location on the mount in a location where they do not interfere with the overlapping flanges on the mount 31 and door 34.

Thus, it is to be understood that variations and modifications can be made on the aforementioned structure without departing from the concepts of the present invention, and further it is to be understood that such concepts are intended to be covered by the following claims unless these claims by their language expressly state otherwise.

The embodiments of the invention in which an exclusive property or privilege is claimed are defined as follows:

1. A vent apparatus for assembly to a building exterior wall, comprising:

a mount adapted for attachment to a building exterior wall and having an air flow opening generally matching an air outflow passageway in the building exterior wall; the mount including a wall-adjacent main flat panel and four flanges extending from edges of the main flat panel, including a bottom flange of the four flanges extending non-perpendicularly from the main flat panel;

a housing attached to and covering the mount, the housing including a top wall of less than about 1½ inches, opposing side walls, and an outer planar angled wall connecting the top and side walls; the angled wall extending at about 20-30 degrees from vertical;

a door pivoted to the mount for movement by gravity to a closed position but being movable to an open position when air flows out from the air outflow passageway; the door having a center flat panel and three flanges extending from edges of the flat panel including a bottom flange; and the side walls joining with the angled wall to form a downwardly and outwardly-extending chute extending below a bottom edge of the mount and door, whereby the angled wall and side walls make bird access to the air outflow opening very difficult; the angled wall and the top wall combining to prevent nesting thereon;

wherein the side walls have downwardly-angled bottom edges that angle outwardly away from the mount;

wherein a lowermost edge of the angled wall extends below the air flow opening by a dimension that is at least 50% greater than a vertical height of the air flow opening;

wherein the bottom flanges of the mount and door overlap when the door is in the closed position, thus making entry more difficult when the door is closed;

wherein the bottom flange of the mount is horizontally larger than the bottom flange of the door;

wherein the bottom flange of the mount is angled and non-parallel to the bottom flange of the door when the door is in the closed position, the angle of the bottom flange of the mount extending upwardly away from the air flow opening and extending inward beyond the door's bottom flange when the door is closed to thus combine with the bottom flange of the door to discourage a nest from being built inside the housing.

2. The apparatus of claim 1, wherein the housing is made from a one piece sheet.

3. The apparatus of claim 1, wherein the mount is made from a one piece sheet.

4. The apparatus of claim 1, wherein the door is made from a one piece sheet.

5. The apparatus of claim 1, including grommets on the mount to reduce noise when the door swings closed.

* * * * *